United States Patent [19]

Wilhelm

[11] 4,080,214

[45] Mar. 21, 1978

[54] BINDING MEDIUM AND CERAMIC SHELL COMPOSITION FOR A PRECISION CASTING-MOLD

[75] Inventor: Bruno Wilhelm, Winterthur, Switzerland

[73] Assignee: Sulzer Brothers Ltd., Winterthur, Switzerland

[21] Appl. No.: 659,559

[22] Filed: Feb. 19, 1976

[30] Foreign Application Priority Data

Mar. 17, 1975 Switzerland ..... 3342/75

[51] Int. Cl.[2] ..... B28B 7/34

[52] U.S. Cl. ..... 106/38.35; 106/38.3; 106/287.1; 106/287.3

[58] Field of Search ..... 106/38.22, 38.2, 38.35, 106/38.3, 287 SB, 287 SE, 84

[56] References Cited

U.S. PATENT DOCUMENTS

| | | | |
|---|---|---|---|
| 2,852,399 | 9/1958 | Bellezanne | 106/38.35 |
| 3,329,520 | 7/1967 | Emblem et al. | 106/287 SE |
| 3,832,204 | 8/1974 | Boaz | 106/287 SE |
| 3,879,206 | 4/1975 | Nestler et al. | 106/287 SB |

*Primary Examiner*—Lorenzo B. Hayes

*Attorney, Agent, or Firm*—Kenyon & Kenyon, Reilly, Carr & Chapin

[57] ABSTRACT

The binding medium employs a mixture of ethyl silicate, anhydrous solvent and organo-functional hydrophilic silicon compounds containing at least one carbon-fixed amino group. The binding medium is capable of absorbing humidity from the air to bring about hydrolysis. The binding medium is also capable of unlimited durability if stored in an air-free dry condition. A hydrophilic alcoholate of titanium may also be added to the mixture to improve hydrolysis and gelling. The binder is mixed with a refractory ceramic filler to form a ceramic shell composition.

9 Claims, No Drawings

BINDING MEDIUM AND CERAMIC SHELL COMPOSITION FOR A PRECISION CASTING-MOLD

This invention relates to a binding medium for a ceramic shell of a precision-casting mold.

As is known, many binders have been used in the manufacture of precision-casting molds, for example as described in U.S. Pat. No. 3,815,658. In some instances, use is made of a binder having a basis of an ethyl silicate which can hydrolyze and gel while absorbing water. On occasion, such silicates employ hydrolysis-starting additives of acidacting or base-acting type. In order to make a casting mold, these binders are mixed with powdered refractory ceramic substances, for example zirconium silicate, quartz or mullite, into a slick-like mass and patterns are dipped into the mass to form a mold shell. However, in "acid" hydrolysis in which acid and water are added and following which gelling begins, the stability of the mold mass containing the binding medium is limited. In order to provide some stability, it has been known to obtain hydrolysis of the binding medium in an alkaline region by the addition of an organic amine, such as piperidine or dicyclohexylamine; hydrolysis being initiated upon an addition of water. Without the water, these basic binding media, or the green mold masses formed thereby, remain stable. However, if these binding media are used in combination with urea patterns, then the highly polar substances of water and the alcohol contained in the binding medium mixture react with the urea surface of the pattern. This, in turn, leads to surface defects of the innermost mold layer and, thus, of the casting.

Accordingly, it is an object of the invention to provide a binding medium which retains the durability of known premixed basic binding media while avoiding the imposition of surface defects in urea patterns.

It is another object of the invention to provide a binding medium capable of long storage.

It is another object of the invention to provide a binding medium which does not attack urea.

Briefly, the invention provides a binding medium for a ceramic shell of a precision casting mold shaped by means of a urea pattern wherein the binding medium is converted into hydrolyzed silicic acid while absorbing water from the atmosphere. For this purpose, the binding medium contains an alkaline ethyl-silicate solution produced by an addition of an organic base.

The binding medium comprises a mixture, in percentages by weight, of:

30 to 60% ethyl silicates, which are a mixture of ethyl esters of various polysilicic acids;

20 to 50% anhydrous solvent, which is miscible in any ratio with ethyl silicate and has a dipole moment of 1 Debye (D) at most; and 8 to 30% organofunctional hydrophilic silane containing at least one carbon fixed amino group.

The absorption of water needed for the hydrolysis is effected with the mixture through atmospheric humidity. This absorption of water out of the air has a decisive action and is promoted by the organofunctional silicon compound, whereby the term "organofunctional" means that the bindability of the silicon is set by organic molecule groups. At the same time, the close structural relationship of these silicon compounds to ethyl silicates promotes hydrolysis and the gelling process, thus promoting the efficacy in the binding power of the binding medium.

The binding medium is moreover of pratically unlimited durability, if kept dry with air excluded.

The binding medium may then be mixed with refractory ceramic fillers such as those selected from the group consisting of zirconium silicate, quartz and mullite, to form a mold mass. A urea pattern may then be dipped into the mass to have a coating formed thereon.

After the dippling operation, any absorbed water is directly bonded by hydrolysis, without reacting with the urea. For this reason, solvents which are only slightly polar or not are used — such as xylole, toluene or a mixture of aliphatic mostly-saturated hydrocarbons, because they do not attack or dissolve urea.

The use of a mixture of ethyl silicates from a number of polysilicic acids, as compared with tetraethylorthosilicate, brings the advantage of improved stability, because in mixing the polysilicates, a pronounced cross-linking of the silicon esters occurs.

An improvement of the hydrolysis and gelling, and thus in the last analysis an improvement in the shell quality of the casting-molds, can be obtained when the binding medium contains a supplementary content of 1 to 30% by weight of a hydrophilic alcoholate of titanium. Alternatively, an alcoholate of zirconium and/or aluminum may be used.

The organofunctional amino groups which are particularly valuable are n-beta (amino ethyl) - gamma (amino propyl) -trimethoxysilane or gamma-aminopropyl-triethoxysilane.

The following examples illustrate various ways of forming and using the binding medium.

EXAMPLE 1

Into 240 parts of industrially pure xylole, there is initially mixed 300 parts by weight of ethyl silicates of various polysilicate acids having an about 40% silicon oxide content to form a solution. Next, 130 parts by weight of n-beta (aminoethyl) - gamma (aminopropyl) trimethoxy silane, likewise miscible with xylole, is added to the solution. The resulting mixture forms a binding medium.

EXAMPLE 2

Instead of adding the trimethoxysilane of Example 1, gamma-aminopropyltriethoxysilane is used as the carrier of the amino groups and is added to the solution of xylole and ethyl silicate.

EXAMPLE 3

As in Example 1, 300 parts by weight of ethylsilicates of various polysilicic acids are mixed into 240 parts by weight of solvent, which in this case consists of a mixture of aliphatic hydrocarbons. Thereafter, 70 parts by weight of gamma-aminopropyltriethoxysilane is added to the mixture. After this silicon compound has been well mixed in, 70 parts by weight of tetraisopropylorthotitanate is added.

The binding media produced according to the above Examples are then mixed, in a ratio of 1:6 to approximately 1:3 with refractory ceramic fillers of the aforesaid kind. The masses for dipping, obtained in this way, are then stored in airtight containers. In order to produce a casting-mold, a suitable urea pattern is then dipped in this mass, sanded with a refractory material, and then air-dried in a surrounding atmosphere of at least 50% relative humidity. After the first coat is dried, further layers are applied by repeating the dipping and sanding process, until the desired thickness is applied.

The binding medium has multiple uses, e.g. for making shells in a cycle of two dipped coatings daily, or for all rapid processes whose cycle consists of a dipping operation each 2 hours. With the latter process, it is advantageous for the surrounding air to be humidified by a humidifier.

Of course, it is also possible to dip a pattern into the dipping mass only for the first pattern-approximating coating, and to make the next coatings with known binders, e.g. acid-hydrolized binders or those having aqueous colloidal silicic acid.

Tests made with the coatings produced by the binding medium of the invention give excellent smooth shell surfaces with a very small tendency of the mold layers to wear off. Cracks were also not observed, and the strength obtained met requirements.

What is claimed is:

1. A binding medium for use with a urea pattern to form a ceramic shell of a precision-casting mold consisting essentially of a mixture of 30 to 60 percent by weight of ethylsilicate;

20 to 50 percent by weight of anhydrous solvent, said solvent being miscible with said ethylsilicate and having a dipolar moment of one Debye maximum; and 8 to 30 percent by weight of an organofunctional hydrophilic silane containing at least one carbon fixed amino group, said mixture being capable of absorbing water for hydrolysis thereof.

2. A binding medium as set forth in claim 1 wherein said ethylsilicate is an ethyl ester of a polysilicic acid.

3. A binding medium as set forth in claim 1 wherein said mixture further includes 1 to 30 percent of a hydrophilic alcoholate of titanium.

4. A binding medium as set forth in claim 1 wherein said silane is gamma-aminopropyl-triethoxysilane.

5. A binding medium as set forth in claim 1 wherein said silane is n-beta (aminoethyl) - gamma (aminopropyl) - trimethoxysilane.

6. A ceramic shell composition consisting essentially of the binding medium as set forth in claim 1 in combination with a refractory ceramic filler in a ratio of from 1:6 to 1:3 of said medium to said filler.

7. A ceramic shell composition as set forth in claim 6 wherein said filler is selected from the group consisting of zirconium silicate, quartz and mullite.

8. A binding medium for a ceramic shell of a precision-casting mold comprising a mixture of 240 parts by weight xylole, 300 parts by weight of an ethyl silicate of a polysilicate acid having about forty percent silicon oxide content, and 130 parts by weight of a xylole-miscible n-beta (aminoethyl) - gamma (aminopropyl) trimethoxysilane.

9. A binding medium for a ceramic shell of a precision casting mold comprising a mixture of 300 parts by weight of an ethylsilicate of a polysilicic acid, 240 parts by weight of a solvent consisting of aliphatic hydrocarbons, 70 parts by weight of gamma-aminopropyl-triethoxysilane and 70 parts by weight of tetraisopropylorthotitanate.

* * * * *